United States Patent [19]

Holling et al.

[11] 4,378,128

[45] Mar. 29, 1983

[54] AMBULANCE

[75] Inventors: Gerd Holling, Bonn; Peter Nussbaum, Rheinbach, both of Fed. Rep. of Germany

[73] Assignee: Christian Miesen, Fahrzeug und Karosseriewerk GmbH, Bonn, Fed. Rep. of Germany

[21] Appl. No.: 219,988

[22] Filed: Dec. 24, 1980

[30] Foreign Application Priority Data

Jan. 10, 1980 [DE] Fed. Rep. of Germany ..... 3000756

[51] Int. Cl.[3] ..... A61G 3/00

[52] U.S. Cl. ..... 296/19; 5/9 B

[58] Field of Search ..... 296/19; 5/8, 9 R, 9 B, 5/10

[56] References Cited

U.S. PATENT DOCUMENTS

| | | | |
|---|---|---|---|
| 1,341,441 | 5/1920 | Sagel | 5/9 R |
| 3,736,601 | 6/1973 | Riches | 5/9 R |
| 3,858,254 | 1/1975 | Coomes | 5/8 |

FOREIGN PATENT DOCUMENTS

| | | | |
|---|---|---|---|
| 1250595 | 9/1967 | Fed. Rep. of Germany | 296/19 |
| 2620939 | 5/1978 | Fed. Rep. of Germany . | |
| 2844080 | 7/1979 | Fed. Rep. of Germany | 296/19 |
| 1098159 | 7/1955 | France . | |

*Primary Examiner*—Robert R. Song

*Attorney, Agent, or Firm*—Armstrong, Nikaido, Marmelstein & Kubovcik

[57] ABSTRACT

An ambulance has two stretcher support stages placed one over the other next to one side wall of the ambulance for taking up stretchers and near the side wall there is a single guiding upright or two spaced guiding uprights, on which runners are guided and on which they may be locked at different heights. On the runners or sleeves, brackets are fixed, more specially by way of horizontal bearings, the stretcher stages being supported on the brackets. Rails running in the length-direction of the ambulance, and designed for supporting the stages, may be changed in length so that the separate runners may undergo separate adjustment in height. The front upright or a support with the same effect is fixed to the side wall of the ambulance or to the ambulance's floor, while the back guiding upright is supported by way of a floor wheel on the ambulance floor, such wheel being fixed directly to the lower end of the upright or to a post on which the upright is supported. Furthermore, the ends of the brackets supporting the lower stage which are nearest to the middle of the ambulance are supported by way of floor wheels on the ambulance floor. The front brackets are joined up by way of bearings (with an upright axis) with the front guiding upright or the support so that the back ends of the two stretcher support stages may be turned towards the middle of the ambulance in a horizontal plane. Furthermore, the guide rails placed towards the middle of the ambulance may be turned about a front upright bearing and may be moved, using a horizontal guide tube with a runner, towards the middle of the ambulance.

The back supporting and guiding upright has a locking system for fixing it to the ambulance side wall. Furthermore, the back end of the top stretcher support stage, which is nearer the middle of the ambulance, may be locked with the back door of the ambulance in the transport position by using a locking bolt.

13 Claims, 17 Drawing Figures

AMBULANCE

BACKGROUND OF THE INVENTION (i) Field to Which the Invention Relates

The present invention is with respect to ambulances having stretcher support stages placed one over the other and next to one side wall of the ambulance.

(ii) The Prior Art

An ambulance designed on these lines, that is to say with two stretcher stages placed one over the other next to the side walls, is seen in French Pat. No. 1,098,159. The separate stretcher stages are unmovingly fixed to the side walls of the ambulance by way of brackets. However, they may be folded upwards so as to be resting against the side walls. In the case of this design, no change in the height of the stages for loading and unloading stretchers and no change in the angle of the stages (for example so that the head or foot end of a stretcher is lowermost) is possible. Furthermore, the distance between the door posts has to be the same as the breadth of the space inside the ambulance to make it possible for the stretchers to be loaded and unloaded.

An ambulance with two stretcher support stages placed one over the other next to one side wall of the ambulance is to be seen in German Offenlegungsschrift specification No. 2,620,939, in which case the stretchers are supported by horizontal brackets fixed to posts which, in turn, are fixed to the rest of the structure of the ambulance. For loading and unloading, the top stretcher stage is supported on guide rails, which may be telescoped and so pulled outwards, while their inner ends are turningly supported on the front, fixed bracket. The loading end of the stage may be swung outwards using a turning lever system and, on doing this, lowered. Height adjustment of the separate stretcher stages is not possible in the case of this earlier design. Furthermore, the turning lever system for the upper stretcher stage is generally complex.

SHORT OUTLINE OF THE INVENTION

One purpose of the present invention is that of designing an ambulance which is simple in structure and having two stretcher stages, one placed over the other and which may undergo adjustment in their height separately as desired, the stretcher stages being able to be so adjusted that the foot or head end is lowered. Furthermore, it is to be possible to make use of vehicles with normally supplied bodies or bodywork, in the case of which the door opening of the doors at the back of the ambulance is less than the breadth inside the ambulance.

This purpose is effected in that near the side wall of the ambulance, at least one guiding upright is placed, for example in the form of a pipe, on at least one runner or sleeve, used for supporting one of the stretcher stages, which may be moved upwards and downwards, there being a system for locking the runner in desired positions.

With the ambulance of the present invention, it is readily possible, using a simple design, for the separate stretcher stages to be adjusted into any desired height (that is to say within certain limits). It is furthermore possible for the two ends of each stretcher stage to be supported at different heights (for having the head or the foot end at a lower level or for getting the stretcher stage into the loading and unloading position).

To make it furthermore possible for normally supplied vehicles to be used, as part of a useful further development of the teaching of the invention, the upright placed near the door opening of the ambulance may be moved towards the middle of the ambulance while the ends of the stretcher stages which are furthest from the door opening may be turned about upright axes.

For loading and unloading it is, for this reason, possible for the back ends of the stretcher stages to be turned and run into positions lined up with the door opening.

As part of a further useful development of the invention, the upright which is near the door opening of the ambulance is supported on a wheel on the ambulance's floor so that the upright may be changed in position.

Further useful developments and forms of the invention will be seen from the dependent claims.

LIST OF FIGURES

An account is now given of working examples of the invention in connection with the diagrammatic figures.

DETAILED ACCOUNT OF WORKING EXAMPLES OF THE INVENTION

Figure 1:
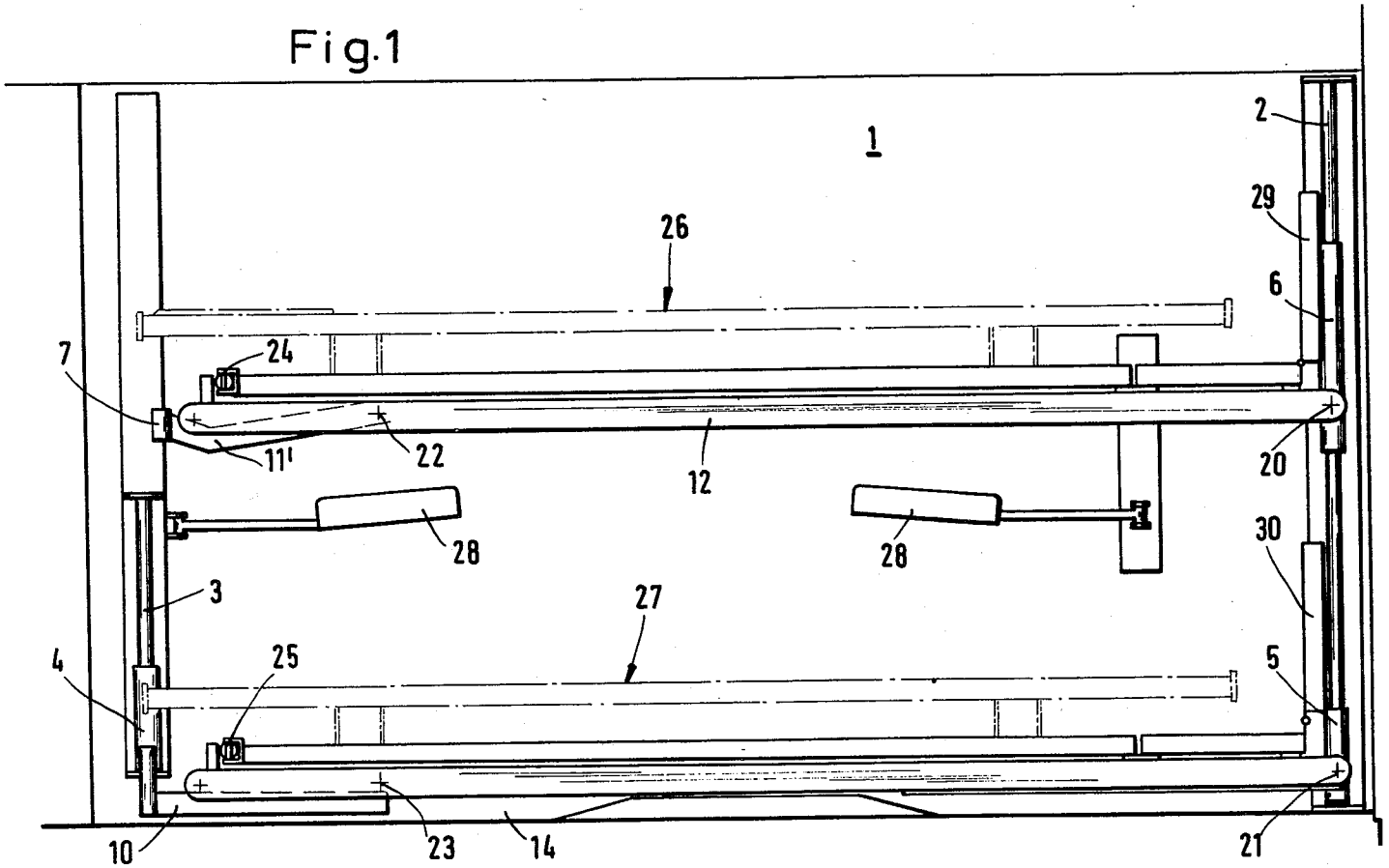
FIG. 1 is a side view of a first working example of the invention, in which the lower and upper stretcher stages and the stretchers are shown in the transport condition.
Figure 2:
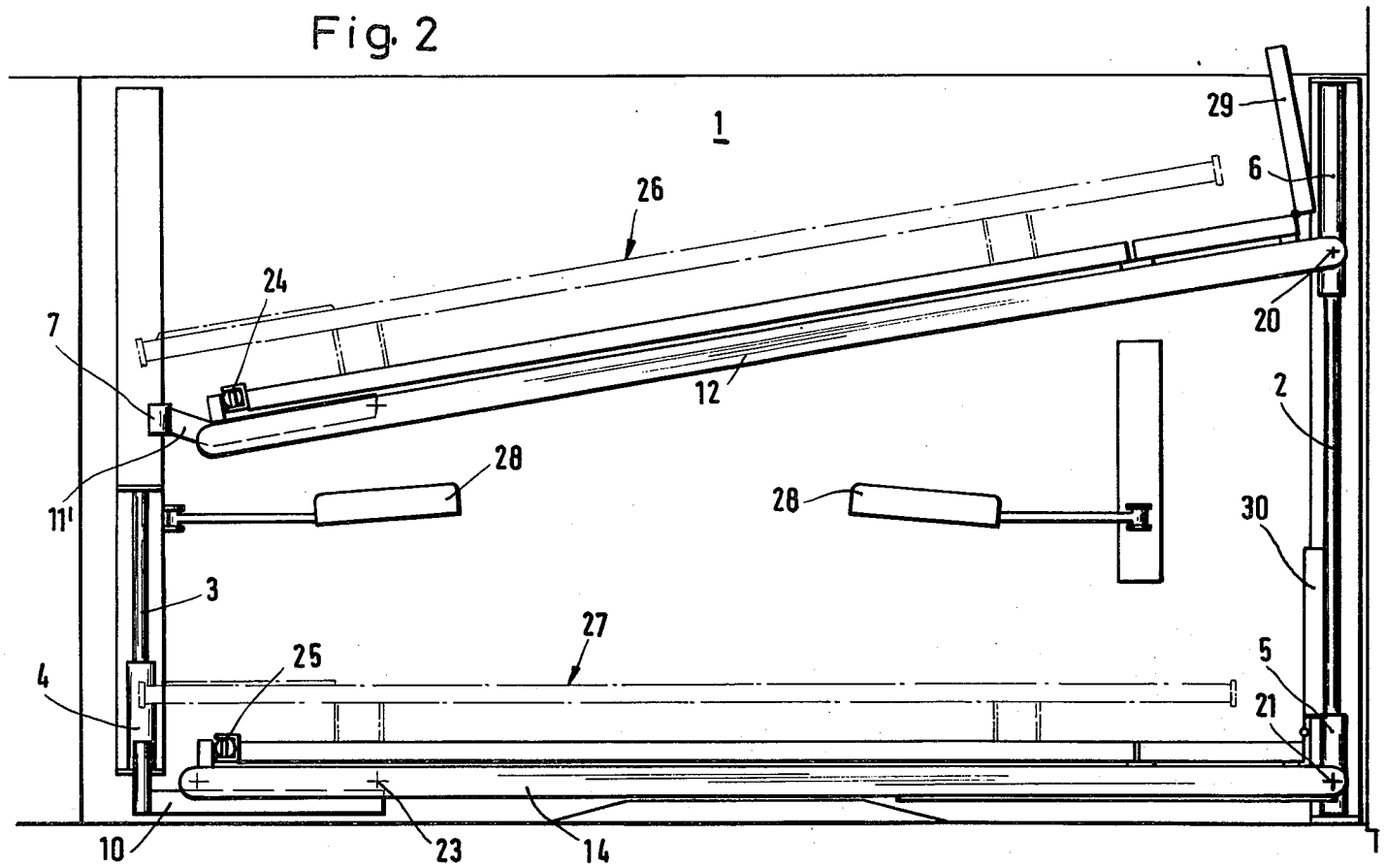
FIG. 2 is a view of the upper stretcher stage with the stretcher in a position in which the head is lowered, while the lower stretcher stage is in the transport position as in FIG. 1.
Figure 3:
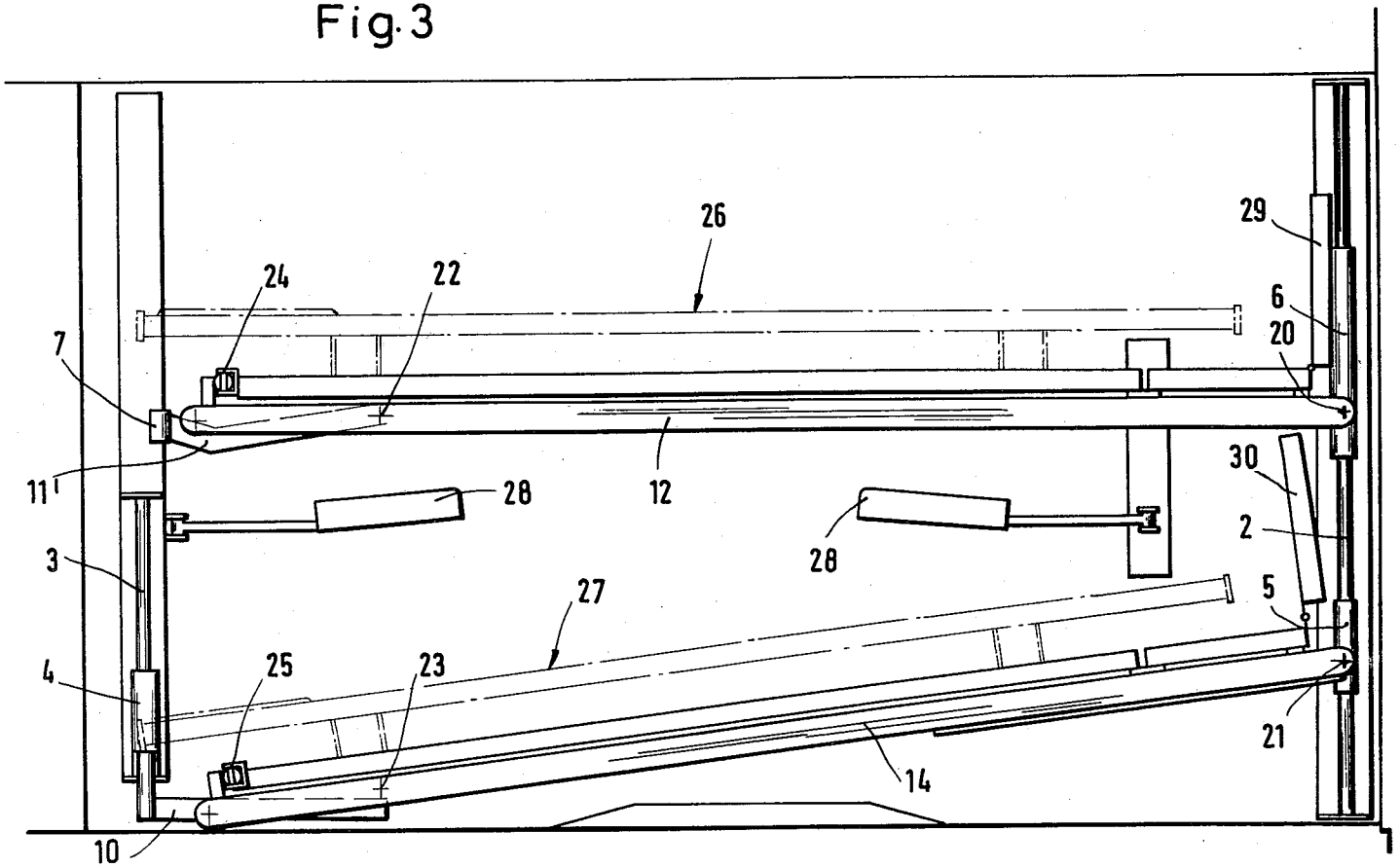
FIG. 3 is a view of the upper stretcher support stage as in FIG. 1 and the lower stretcher support stage with the stretcher placed so that the head end is lowered.
Figure 4:
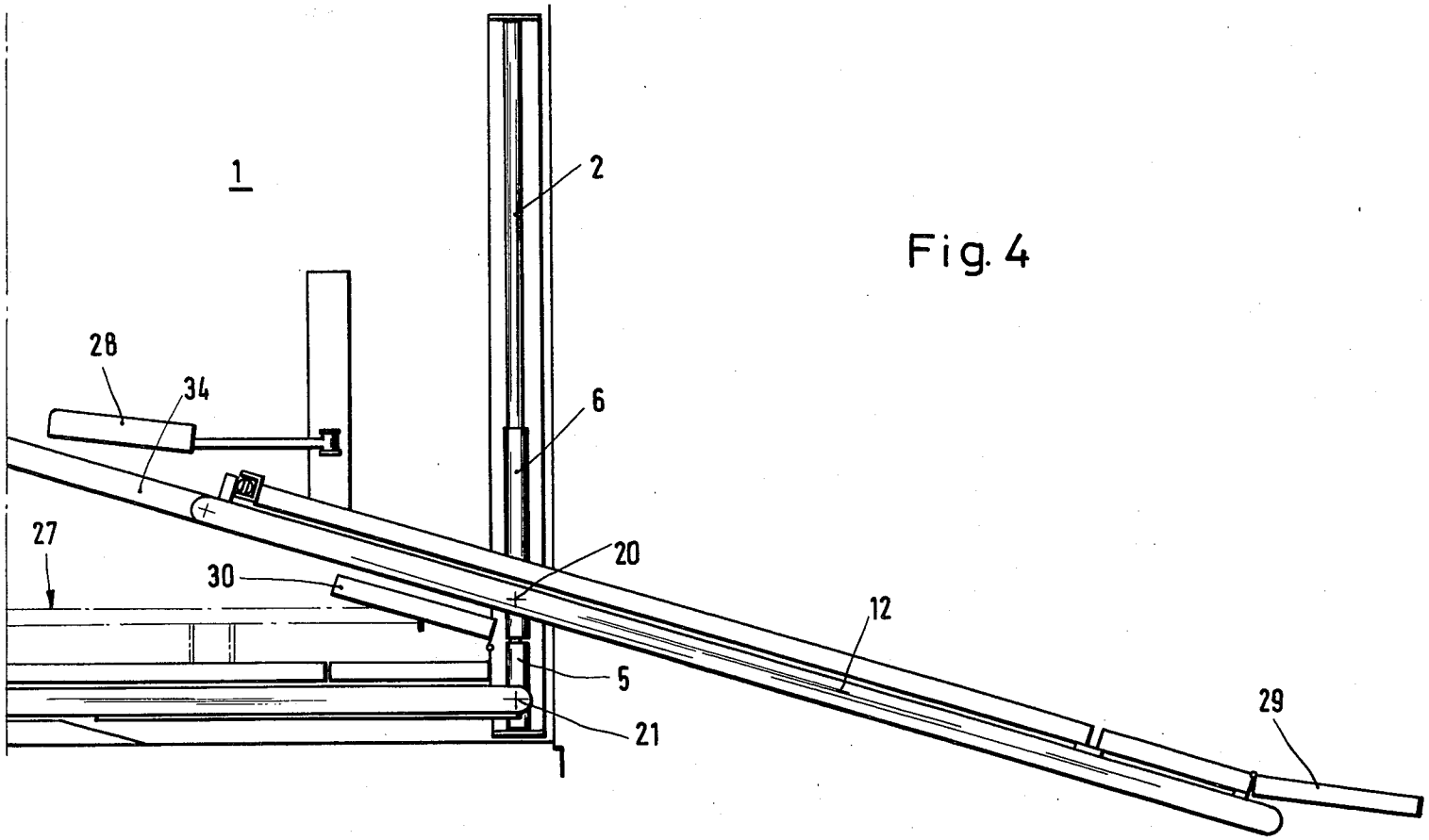
FIG. 4 is a view of the top stretcher stage as pulled out backwards from the ambulance for loading a stretcher on it.
Figure 5:
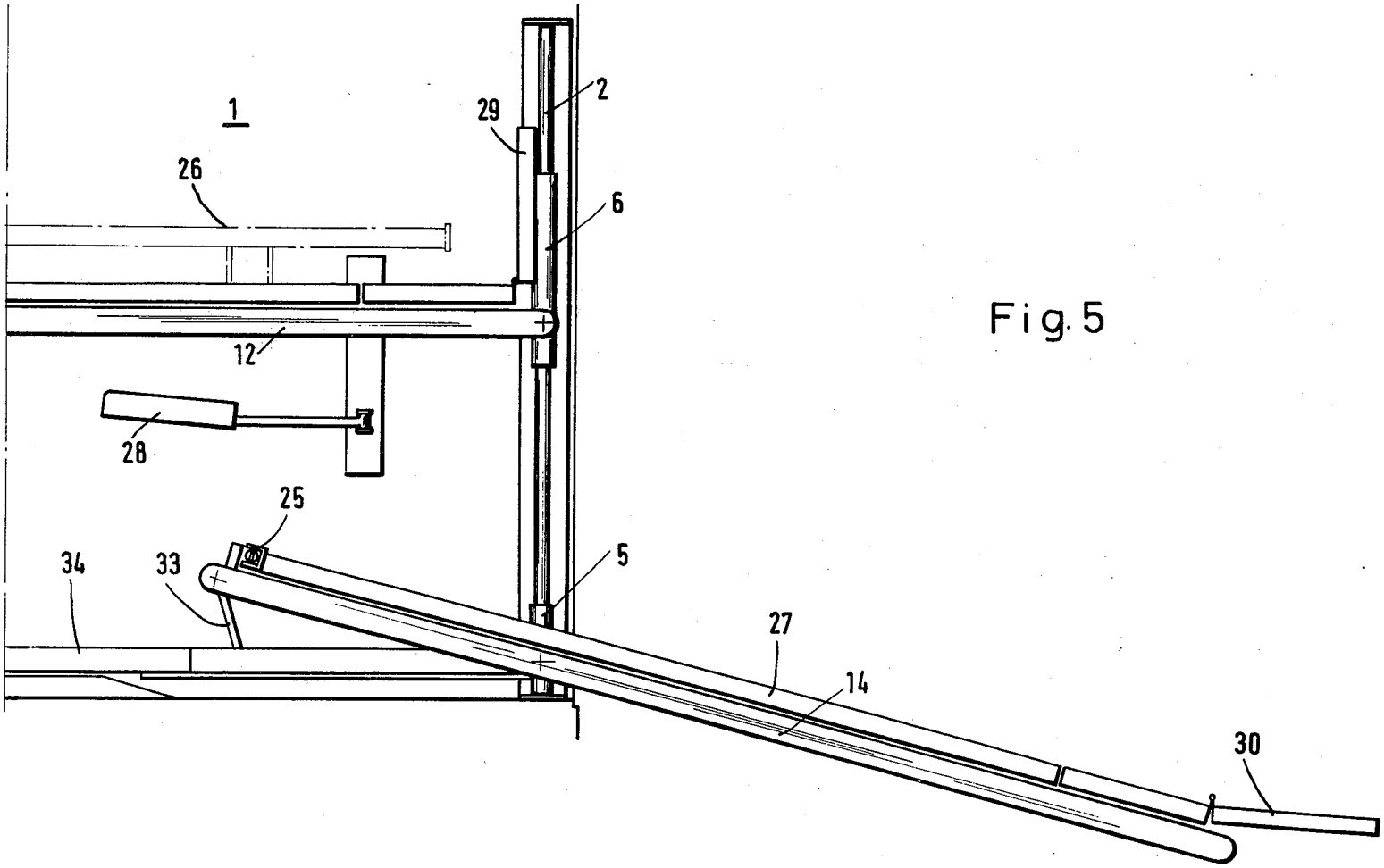
FIG. 5 is a view of the lower stretcher stage as pulled out to the back, and lowered somewhat, for loading purposes while the top stretcher stage is in the transport position as given in FIG. 1.

Turning now to FIGS. 1 to 8 and more especially to FIG. 1, it will be seen that against the off-side wall 1 of an ambulance there are two guiding uprights 2 and 3, in the form of pipes, which are fixed in position. On the back guiding upright 2 (near the loading and unloading opening or door opening of the ambulance) there is a lower runner 5 or sleeve and an upper runner 6 or sleeve which may be moved along the guiding upright 2. On the front guiding upright 3 there is a sleeve-like runner 4, designed on the same lines, which may be moved along the length of the upright 3 or pipe. The runners 4, 5 and 6 are locked in position by spring bolts (not shown) so as to be kept with the desired spacings along the uprights. It is naturally possible for other known locking or gripping systems to be used for locking the runners on the uprights. The front end of the top stretcher stage is in the present case taken up on a fixed support 7, although it would naturally be possible for the front end of the top stretcher stage to be supported by a system using a runner or sleeve, with the same design as the back runner 6.

Figure 6:
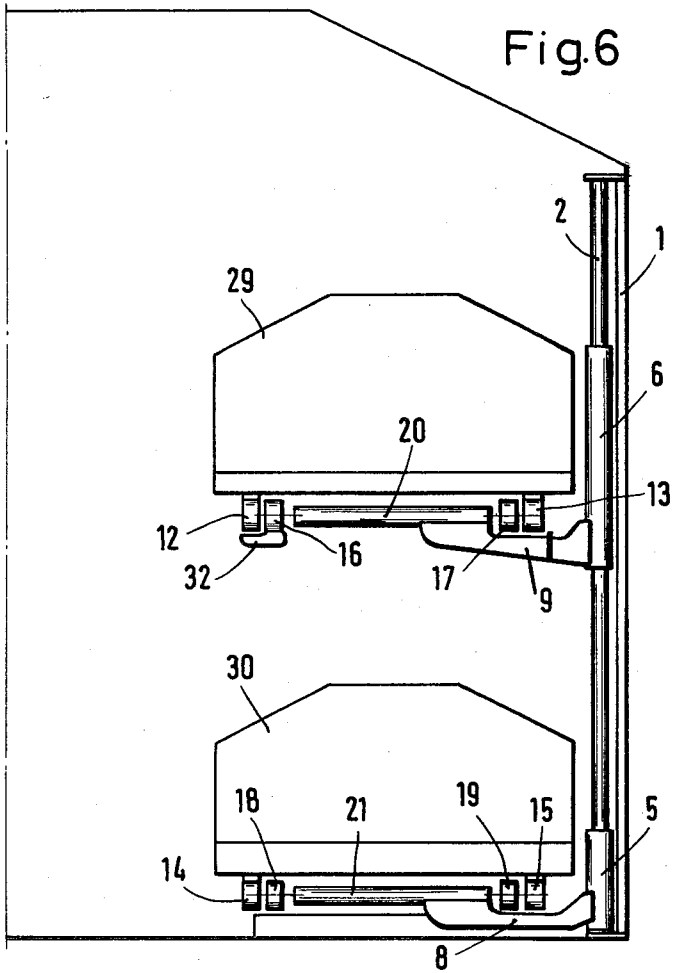
FIG. 6 is a view of the top and lower stretcher stages in the position of FIG. 1, but seen from the back.

Turning now more specially to the view of FIG. 6, as well, in the direction of motion of the ambulance, it will be seen that brackets 8, 9, (FIG. 6) 10 and 11 (FIG. 8) are fixed to runners 4, 5, 6 and support 7. On these brackets 8 to 11, crosspieces 20, 21 and furthermore (see FIG. 3) 22 and 23 are fixed. From FIG. 6 it will be seen that longitudinal rails 16, 17, 18 and 19 are joined to crosspieces 20 to 23 parallel to such rails 16 to 19, the stretcher stages 26, 27 have longitudinal beams 12, 13, 14 and 15, which may be moved in relation to the longitudinal rails, for example by using a guiding system with synthetic resin runners, in the longitudinal direction (see more specially FIGS. 4 and 5).

Figure 7:
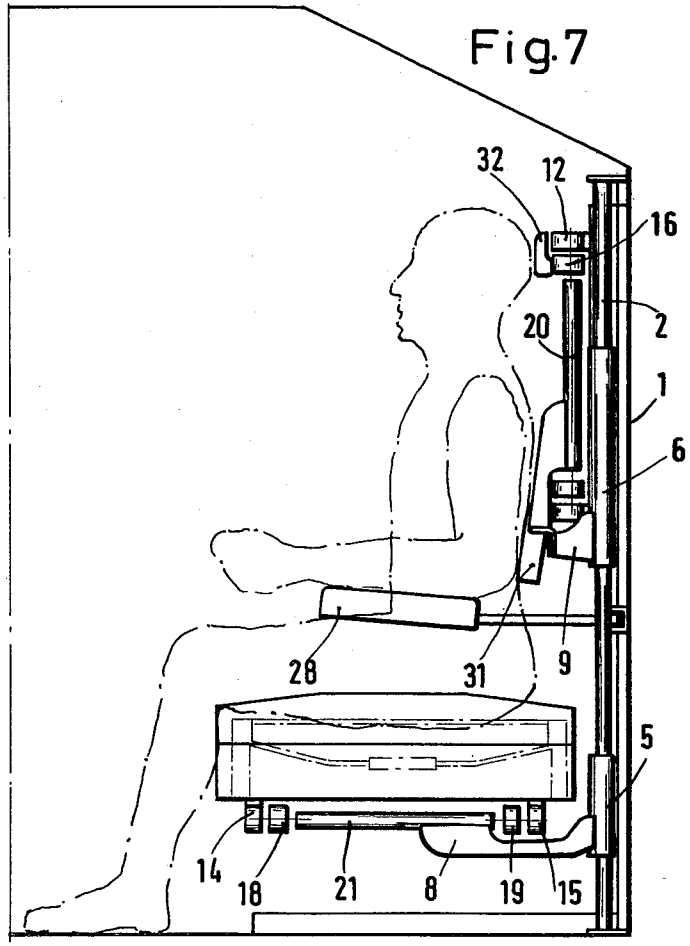
FIG. 7 is a view of the upper stretcher stage after being folded back against the side wall, while the lower stretcher stage with stretcher has a seat placed over it at a somewhat higher level.
Figure 8:
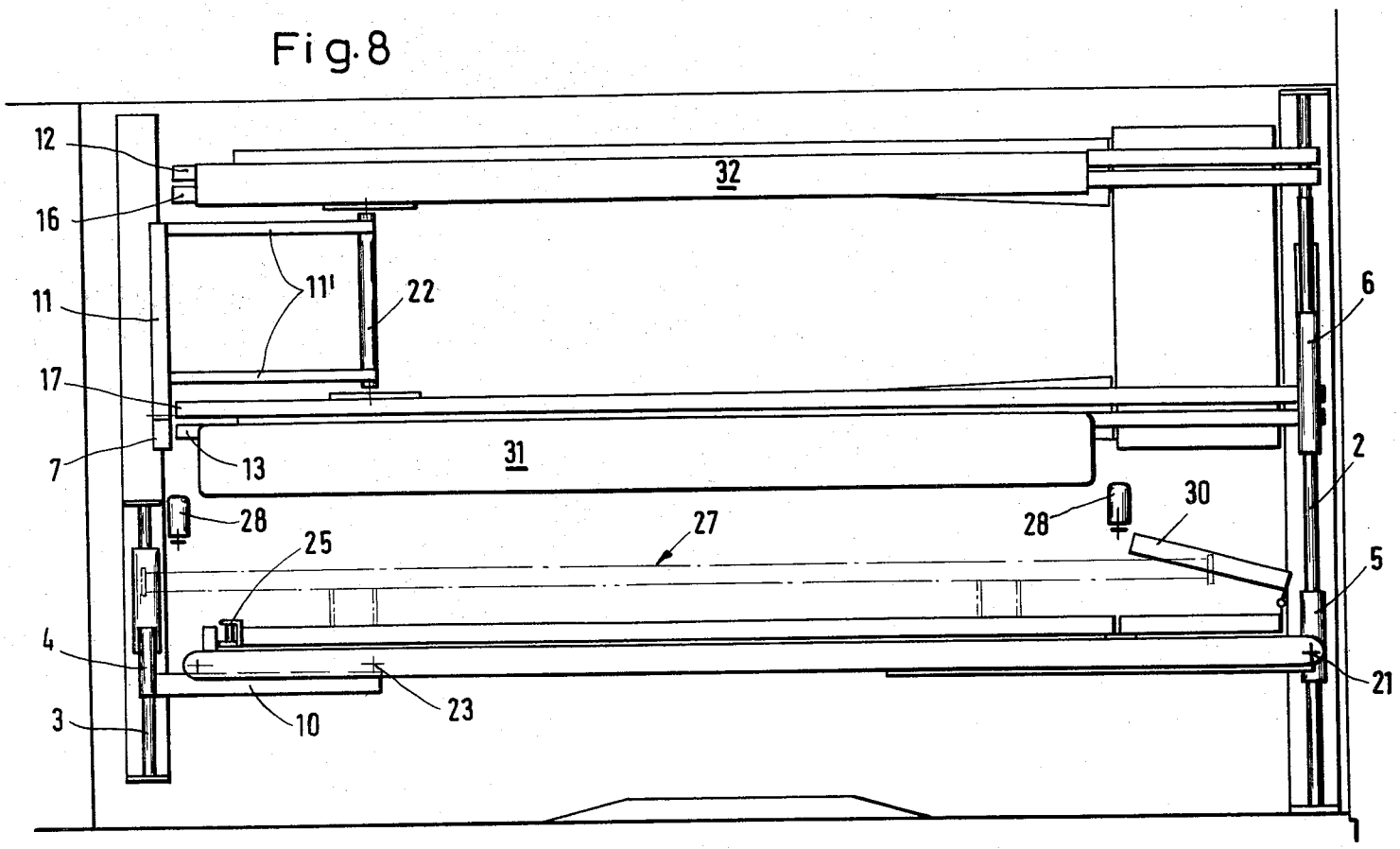
FIG. 8 is a side view of the stretcher stages as in FIG. 7.

As shown in FIGS. 7 and 8, the top stretcher stage 26 may be folded back against the side wall of the ambulance. This is made possible by turning joints of the brackets 9 (see FIG. 7) and 11 (see FIG. 8). The lower side of the upper stretcher stage 26 has a backrest 31 (FIG. 7) and a headrest 32 so as to give the desired comfort for a person using the lower stretcher stage 27 as a sea. For further comfort, armrests 28 are present, which may be folded into positions of use (see FIG. 7). At the loading and unloading end the two stretcher stages 26 and 27 have folding support plates 29 and 30. Because of the length of the bracket 10 and of bracket arms 11′ (see FIG. 8) the front supporting crosspieces 22 and 23 are at some distance from the front ends of the stretcher stages so as to be nearer the center of gravity of the stretcher when in use, this making it easier for the stretcher to be turned about its crosspiece 22 or 23 on loading and unloading.

For such loading of the upper stretcher stage 26, its back end is lowered by changing the position of runner 6 so that it is as low down as possible (that is to say until runner 6 comes up against runner 5). The front end, however, of the stretcher stage 26 is kept at the level of crosspiece 22. The longitudinal beams 12 and 13, running in the direction of motion of the ambulance, are then pulled outwards slippingly supported on the longitudinal guide 34 until it arrives at loading and unloading position seen in FIG. 4. After the stretcher has been placed on the stretcher stage, the two are pushed together into the ambulance. The runner 6 is then moved into the desired position to obtain the desired angle of the stretcher, such as horizontal, or with the head lower or the feet lower than the rest of the body. Such adjustment in height may be helped along by using conventional pneumatic springs, not shown.

Loading and unloading of the lower stretcher stage 27 takes place on the same lines, with the runners 4 and 5 best being in their lowermost positions. For stopping any undesired turning or tilting of the lower stretcher stage 27, its front end is connected to a limiting rod 33 (see FIG. 5) running along guide 34 and fixed to the front end of lower stretcher stage 27. By special adjustment of the runners 4 and 5, adjustment to the desired angle of the lower stretcher stage, that is to say so as to be horizontal, or with the head or feet lowermost, is possible. To take into account changes in angle of the stretcher stages, the front end thereof may be moved on brackets 10 and 11 in the longitudinal direction, the upper bracket arms 11′ having a hollow in their top face for keeping the end of the top stretcher stage safely in position.

The two stretcher stages may be moved separately into the positions noted, as will be readily seen when it is kept in mind that the runners 4, 5 and 6 may be separately moved and changed in position.

In the case of the working example of FIGS. 1 to 8, the back door opening is as broad as the space inside the ambulance.

Figure 14:
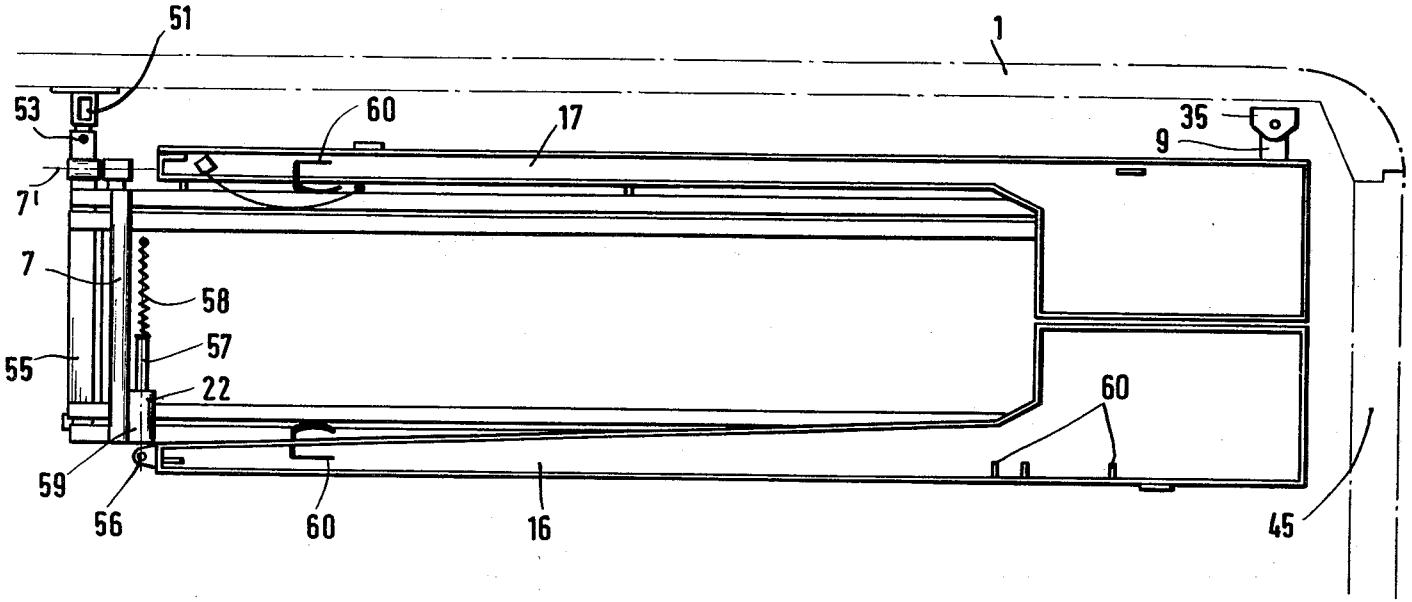
FIG. 14 is a plan view of the top stretcher stage of the second working example of the invention in the position of the parts therefore shown in FIG. 9.
Figure 15:
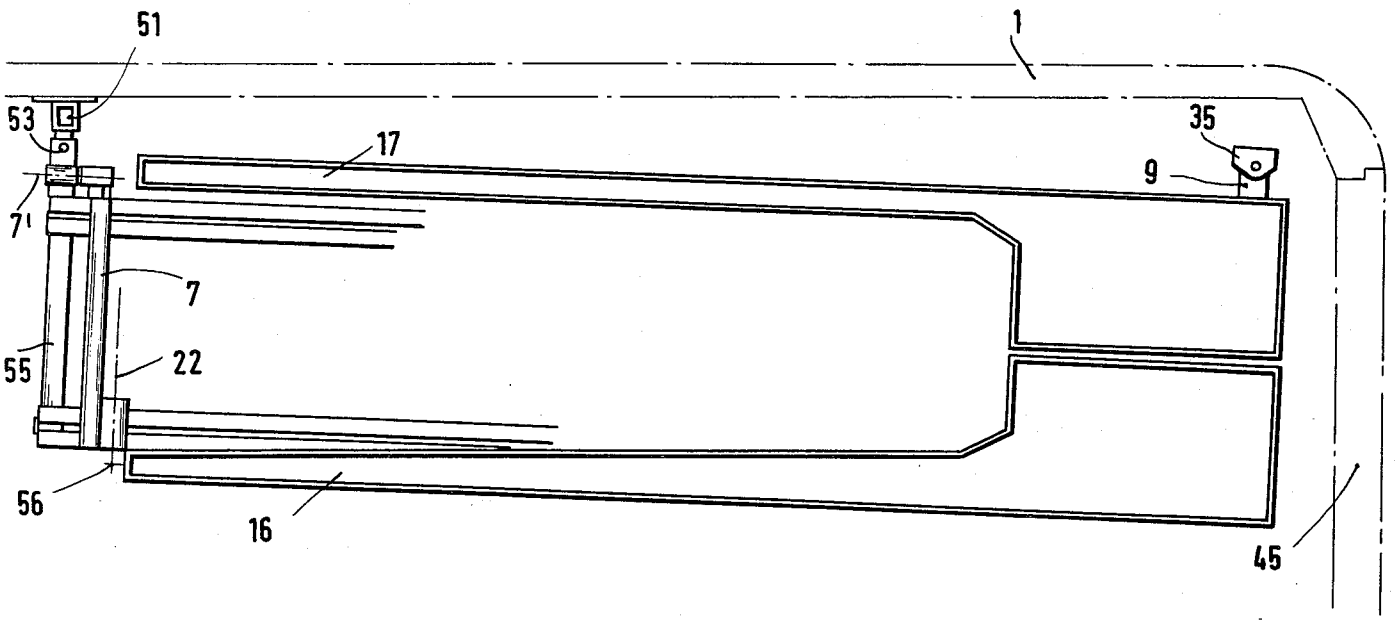
FIG. 15 is a plan view as in FIG. 14 in which case, however, the stretcher stages have been turned towards the middle of the ambulance for loading and unloading and so as to be lined up with the door opening.

If this is not the case for example, (see the door opening 44 in FIG. 11), the stretcher stages have to be turned out of the transport position to be seen in FIG. 14 into that to be seen in FIG. 15. In this case, the stretcher supporting system is made up of a front upright support 51 (being like guiding upright 3 of FIG. 1 in function), fixed to the ambulance side wall 1 and the ambulance floor 1′ (see FIG. 12). Hinge bearings are fixed to this upright support with the bearing axes 53 and 54 being parallel to the upright support 51. The hinge bearings joined to the right hand ends of horizontal crosspieces 10 and 11, which are normal to the ambulance's direction of motion. The ends of crosspieces 10 and 11 nearest to the middle of the ambulance are joined up with a further upright support 52, again using, if desired, locking sliding sleeves. The lower end of upright support 52 is supported on the ambulance floor 1′ by way of a floor wheel 43 or caster. Crosspieces 10 and 11 are used for supporting the lower, and in the other case, upper stretcher stage 27 and 26 (see FIG. 11).

Figure 9:
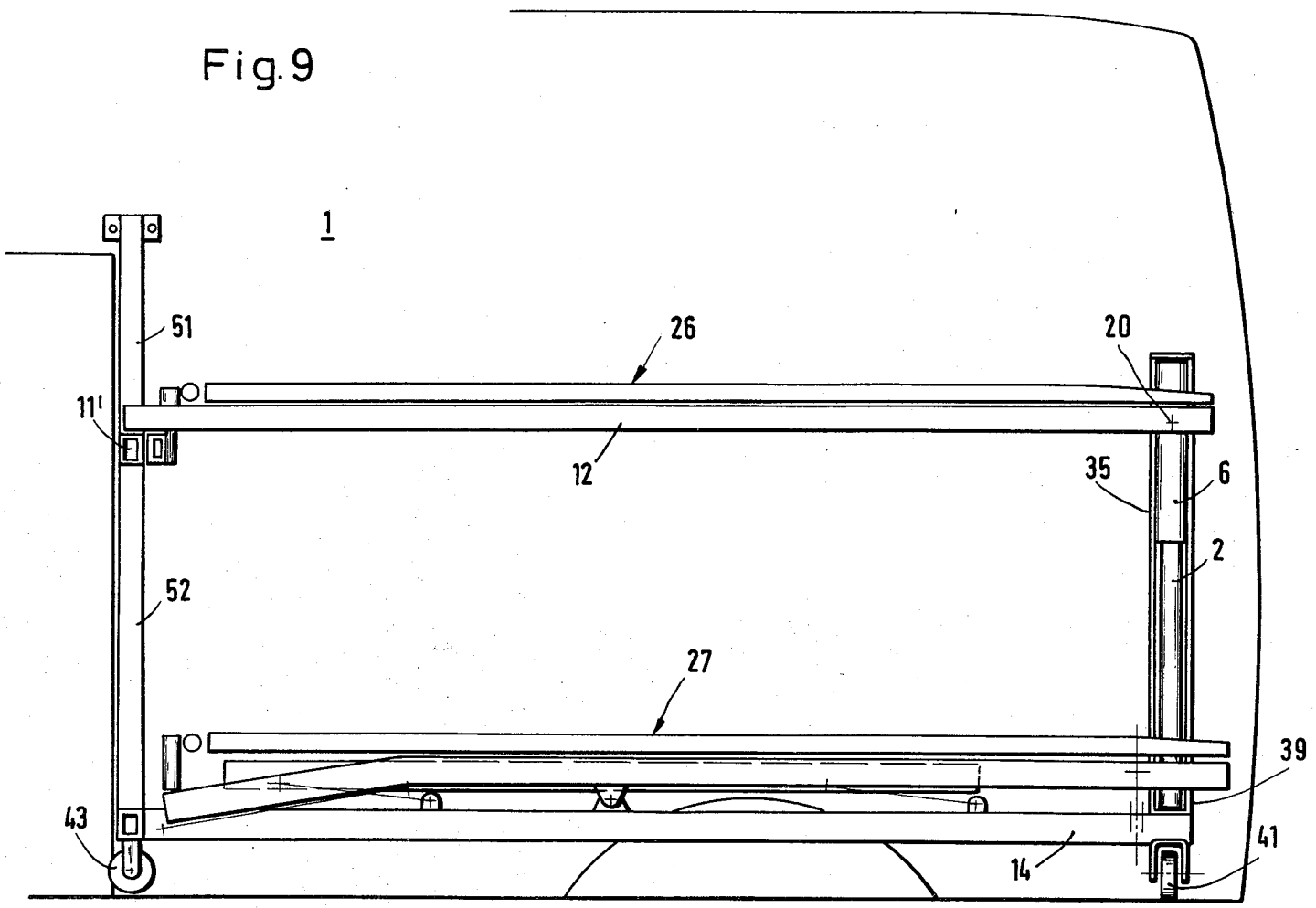
FIG. 9 is a view of a second working example of the invention, as seen from the side, in which the lower and upper stretcher stages are to be seen in the transport position, the figure being generally similar to FIG. 1.

The end of the stretcher support system nearest to the ambulance back door, that is to say the back end, is made up of the guiding upright 2, which is fixed to an upright post 35 as will be seen from FIG. 9 and FIG. 15, the post being for example an U-section. In the working example to be seen, in the case of which only the top stretcher stage undergoes adjustment in height, this guiding upright 2 has the runner 6 placed on it, to which the back top bracket 9 (see FIG. 11) is fixed. The lower end of upright post 35 is supported by way of a floor wheel 42 on the ambulance floor 1'. As a bracket for the lower stretcher stage, a horizontal bracket 37 is fixed to upright post 35 so as to be runing towards the middle of the ambulance. For increasing the strength of the system, it is possible to have a web plate 38 in the angle between the upright post 35 and the horizontal bracket 37 where they are joined together. The end of the horizontal bracket 37 nearest to the middle of the ambulance is, as well, supported by way of a floor wheel or caster 41 on the ambulance floor 1'.

In the transport position the upright support post 35 may be locked and joined to the ambulance side wall 1 by a locking unit 36 (see again FIG. 11) so that upright post 35 is supported and the support system generally is stopped from turning towards the middle of the ambulance.

For making possible upward folding of the top stretcher stage so as to be resting against the side wall of the ambulance, bracket 9 is made in two parts which are hinged together for turning about a turnpin or hinge pin 9'. A front bracket 55 (see FIG. 10) will furthermore be seen to be hingedly supported near the ambulance side wall for turning about a turning axis 55'.

Figure 11:
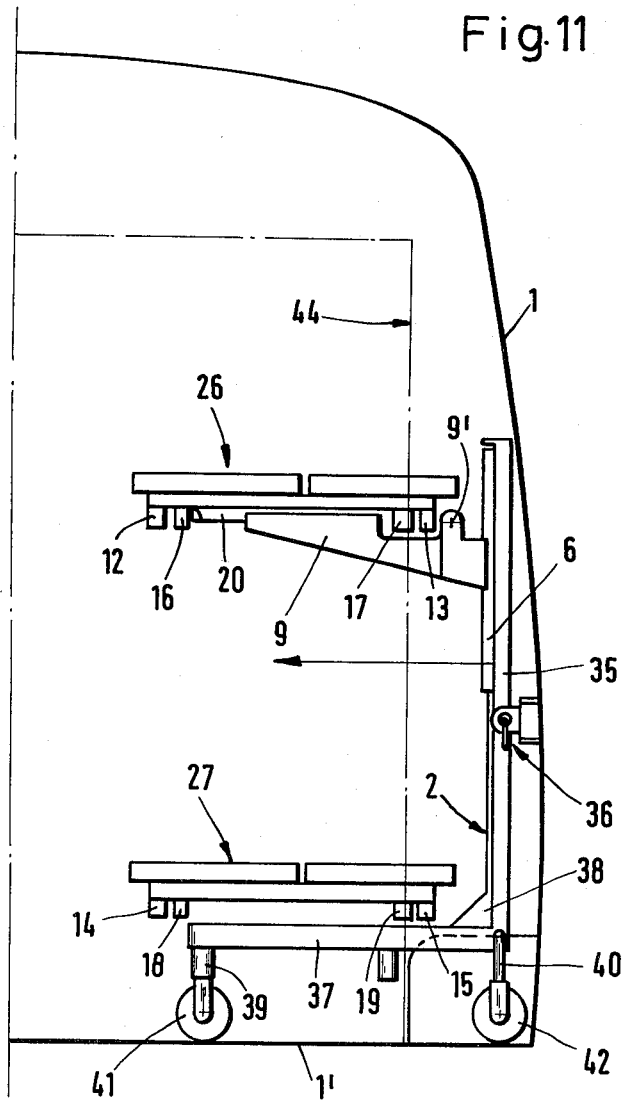
FIG. 11 is a view from the back of the stretcher stages of FIG. 9 with the top and lower stretcher stages in the transport position, looking through the door opening and generally similar to FIG. 7.
Figure 12:
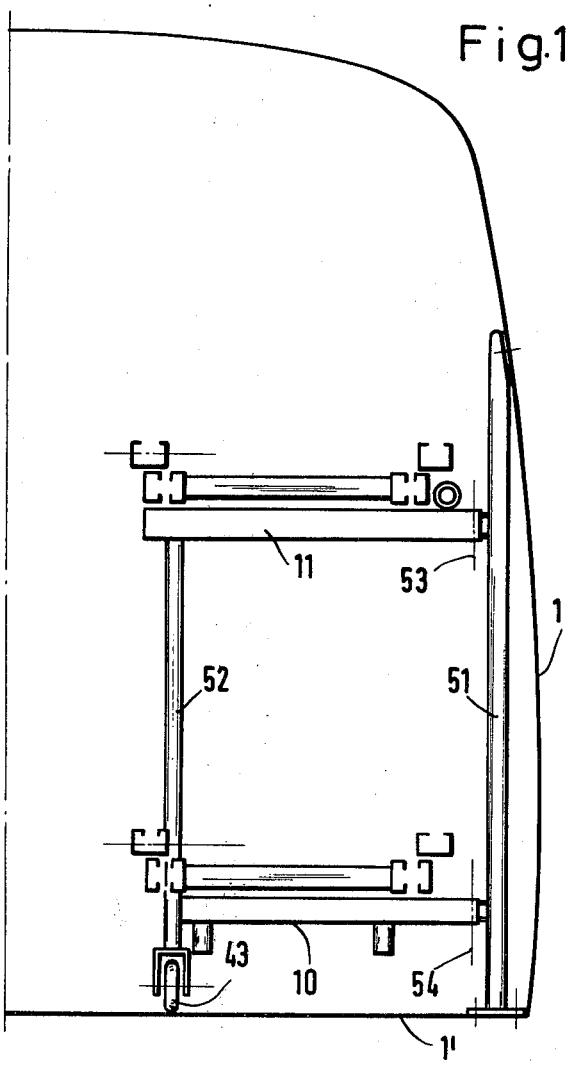
FIG. 12 is a view from the back of the front support system for the upper and lower stretcher stages in the second working example of the invention.
Figure 13:
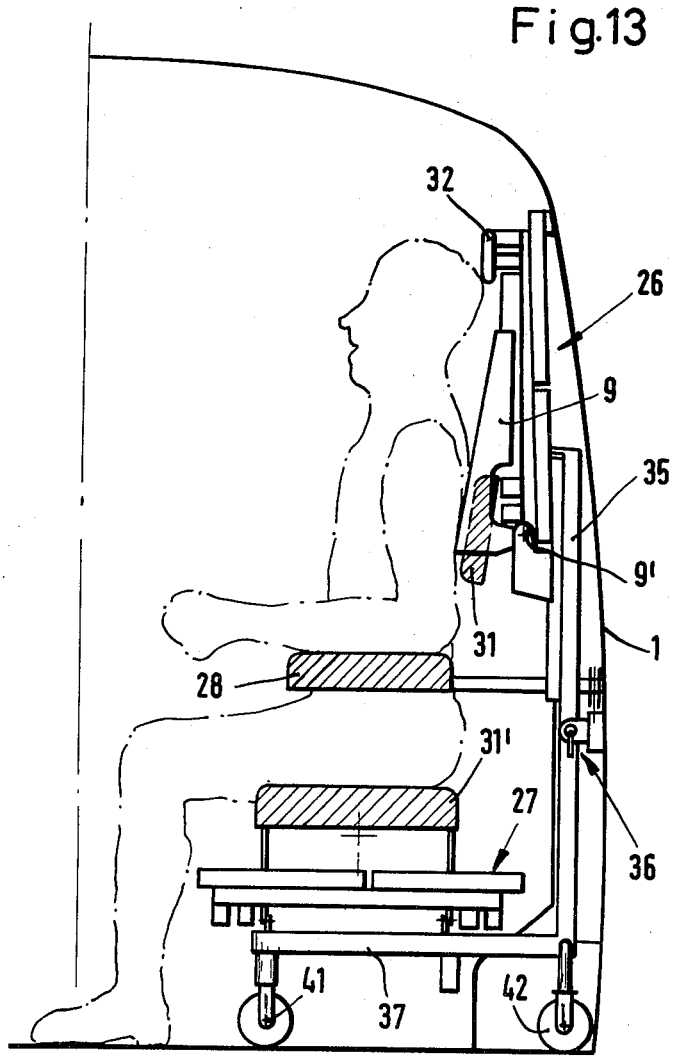
FIG. 13 is a view from the back of the second working example of the invention generally similar to FIG. 7.
Figure 16:
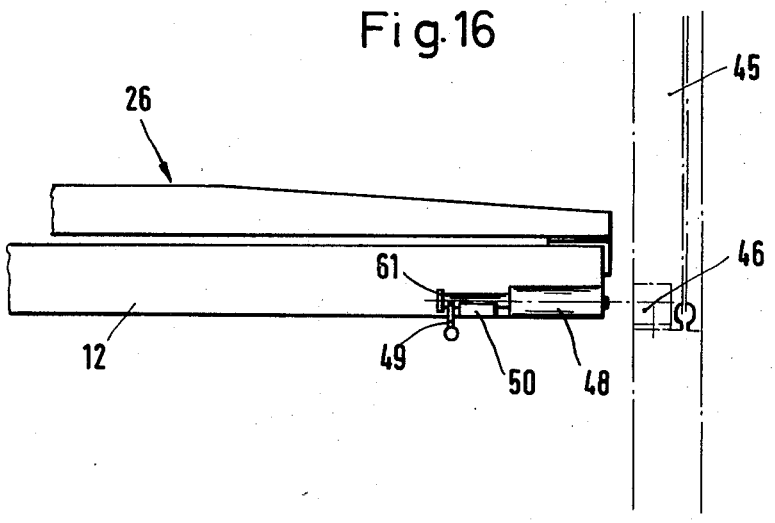
FIG. 16 is a view of the back inner part of the top stretcher stage, forming the second working example of the invention, the locking bolt having been pushed back.
Figure 17:
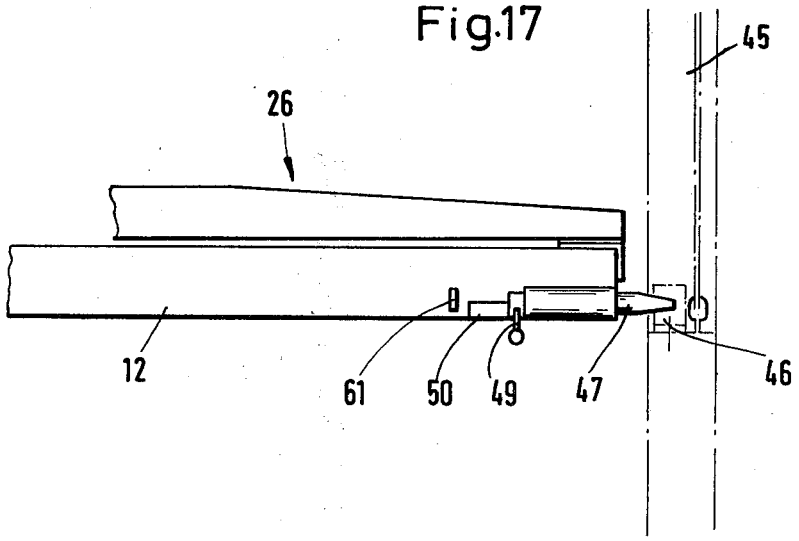
FIG. 17 is a the same view as in FIG. 16, in which, however, the locking bolt has been run into the locking opening in the back door of the ambulance.

The two stretcher stages 26, 27 seen in FIG. 11 for example have longitudinal beams 12, 13, 14 and 15 and longitudinal rails 16, 17, 18 and 19, on which a stretcher is guided. Furthermore, there is a top crosspiece 20 (on the same lines as crosspiece 20 in FIG. 4). Such beams and rails may be conventional so that no detailed account is given thereof. The structure may be increased in strength if the top stretcher stage is locked in the transport position in relation to the ambulance door 45, using the system to be seen in FIGS. 16 and 17 with a locking bolt 47 which is fixed by a bolt guide 48 on one beam 12 near the middle of the ambulance. Locking bolt 47 may be moved along in the direction of motion of the ambulance in its guide and has a driving grip 49, normal to its direction of motion. Furthermore, there is an end stop 61 stopping the locking bolt from being completely pulled out of the guide. A keeper 50 makes it possible for the driving grip 49, and, for this reason, the locking bolt 47, to be kept in its pushed-forward position in which its front end is taken up in a bolt eye 46 on the inner side of ambulance door 45 at the necessary height.

For loading and unloading, the door is firstly opened and the locking unit 36 (see FIG. 11) undone. The complete stretcher support system is then turned about its common axis made up of axes 53 and 54 (see FIG. 12) from the positions to be seen in FIG. 14 to that of FIG. 15, that is to say until the back end of the stretcher or stretcher stage is lined up with the door opening (FIG. 11). On freeing runner 6, the top stretcher stage may now be lowered till the stretcher may be readily pushed into the ambulance or taken therefrom as may be desired.

Figure 10:
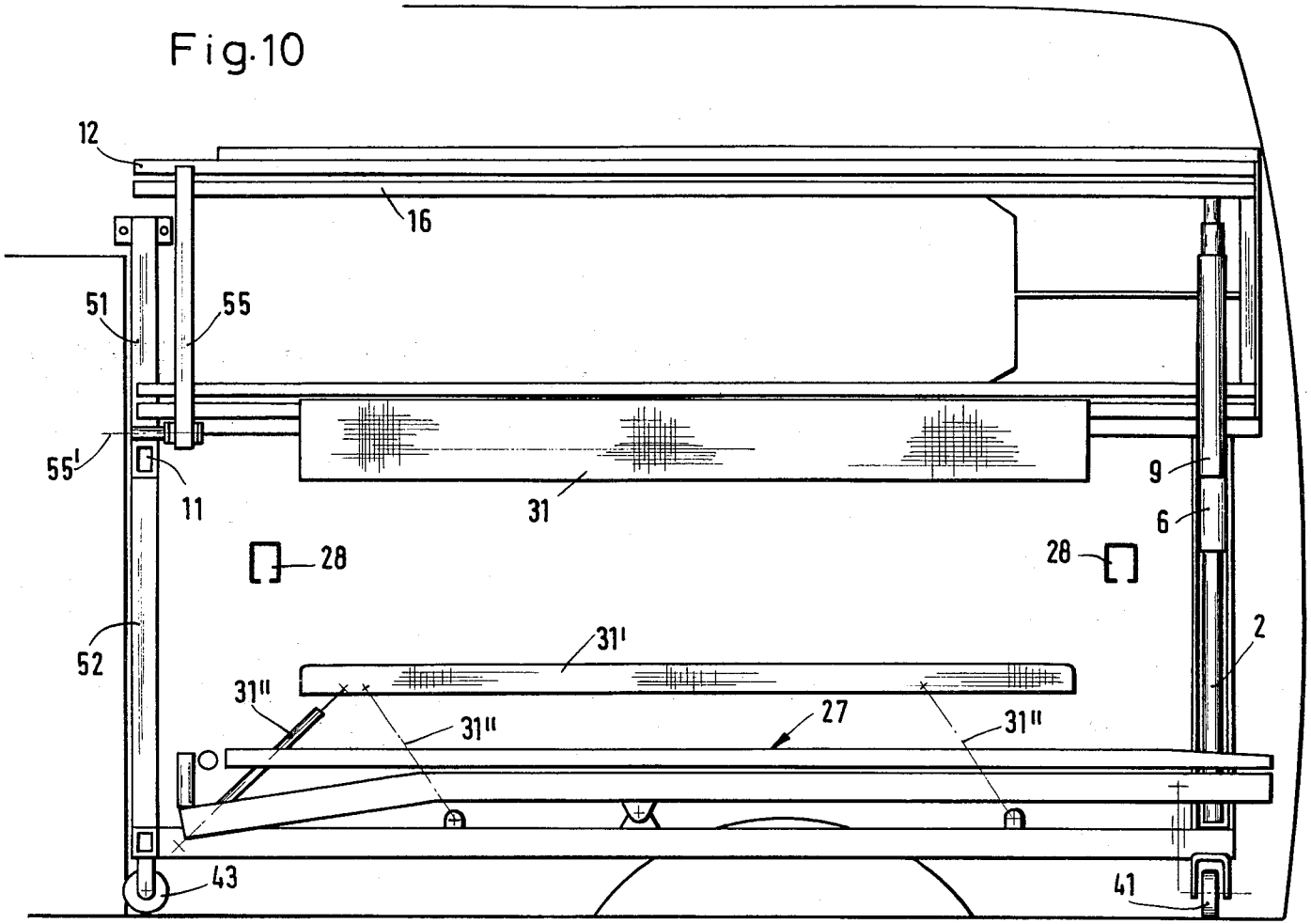
FIG. 10 is a side view of the stretcher stages of FIG. 9 in the case of which the top one is folded back against the side wall of the ambulance and the elongated seat of the lower stretcher stage is in its upper position, generally similar to FIG. 8.

Shown earlier, the top stretcher stage may be folded back against the side wall of the ambulance (see FIGS. 8 and 10) so that a backrest 31 and, if desired, a head support 32 (see FIGS. 6 and 7) may be used by a seated person. Furthermore, armrests 28 (FIGS. 7 and 8) may be folded into positions of use. Between the beams of the lower stretcher stage there is an elongated seat 31' or bench which, as may be seen from FIG. 10, is supported by turning levers 31" so that it may be moved into an upper position of use, it then taking place of the stretcher stage 27 of the first working example as a seat.

As will best be seen from FIG. 14, the guide rails 16 and 17 may be changed with respect to the distance between them and for this purpose the guide rail 16, which is nearest the middle of the ambulance, may be turned about an upright axis 56 so that the distance between guide rails 16 and 17 will become less and less from the back end to the front end of the stretcher stage. Furthermore, there is a horizontal guide pipe 57 on which a runner 59 (see more specially FIG. 14) may be moved. The front end of rail 16 is turningly fixed (for turning motion about axis 56) to runner 59. For this reason, the distance between guide rails 16 and 17 can be changed to be in line with the breadth of a stretcher. For different stretchers locking parts 60 are present on the two guide rails 16 and 17.

All engineering details of the invention as given in the claims, the specification and the figures are important for the invention not only separately, but furthermore in different combinations.

We claim:

1. An apparatus for supporting stretchers in an ambulance, said ambulance having side walls, a front, a back, and a floor, said apparatus including:
   - two stretcher support stages, each stage including a pair of longitudinal beams, and means for supporting said stages one above the other adjacent one of said side walls, said means comprising
   - at least one guide and support upright positioned adjacent one of said side walls and said back,
   - at least one runner slideably mounted on said upright for vertical movement therealong,
   - means for locking said runner at a fixed vertical position on said upright,
   - an upper and a lower forward bracket adjacent said front,
   - an upper and a lower rearward bracket adjacent said back, at least one of which is attached to said runner,
   - four cross-pieces, each cross-piece extending from one of said brackets in a lateral direction,
   - two pairs of longitudinal rails, each pair extending longitudinally from one forward bracket to one rearward bracket and being pivotally attached to the respective cross-pieces for turning about axes normal to the direction of motion of the ambulance,
   - said longitudinal beams of said stages being longitudinally moveably mounted on longitudinal rails.

2. The apparatus as claimed in claim 1, wherein said means for supporting comprises:
   - two guiding and support uprights, one positioned adjacent one of said side walls and said back, the other fixed to said floor adjacent said one of said side walls and said front,
   - at least three runners, two of which are slideably mounted on said upright adjacent said back for vertical movement therealong and the other being slideably mounted on said upright adjacent said front for vertical movement therealong, and
   - means for independently locking each of said runners at a fixed vertical position on its respective upright, whereby each stretcher support stage may be independently inclined longitudinally.

3. The apparatus as claimed in either claim 1 or 2, wherein said upper forward bracket and said upper rearward bracket are pivotally mounted to be turnable about a common axis parallel to the direction of motion of the ambulance whereby the uppermost support stage can be folded about said common axis against said one of said side walls.

4. The apparatus as claimed in claim 1 further comprising a longitudinally extending seat, and means for raising and lowering said seat from a lower position adjacent the lowermost pair of said longitudinal rails and said cross-pieces to an upper position above the lowermost pair of said longitudinal rails and said cross-pieces, said means for raising and lowering being pivotally attached to said seat and the lowermost pair of said longitudinal rails.

5. The apparatus as claimed in claim 1, wherein said upper and lower forward brackets are pivotally connected to said one of said side walls for turning about a vertical axis whereby the rearward end of said support apparatus can be swung away from said one of said side walls.

6. The apparatus as claimed in claim 5, wherein said at least one guiding and support upright includes a first wheel mounted thereon in rolling contact with said floor supporting a lower end of said upright.

7. The apparatus as claimed in claim 6, further comprising a vertical post to which said at least one guiding and supporting upright is affixed having a lower end with which said wheel is pivotally and rotatably attached.

8. The apparatus as claimed in claim 7 further comprising a cross-beam fixed to said lower end of said post and extending perpendicular to the direction of motion of the ambulance, and a second wheel in contact with said floor, pivotally and rotatably mounted on an end of said cross-beam furthest from said post.

9. The apparatus as claimed in claim 8 further comprising a locking device attached to said post for locking said post in a position adjacent said one of said side walls.

10. The apparatus as claimed in claim 8 further comprising:

a vertical support vertically connecting the two forwardmost cross-pieces at an end of each cross-piece furthest from said one of said side walls, said vertical support having a lower end, and a third wheel in contact with said floor pivotally and rotatably mounted on said lower end of said vertical support.

11. The apparatus as claimed in claim 5 wherein said ambulance has a back door, and wherein the longitudinal beam of the uppermost support stage furthest from said one of said side walls has mounted thereon a moving locking bolt moveable parallel to said beam and engageable with said back door when shut.

12. The apparatus as claimed in claim 11, wherein said back door has a bolt-receiving eye, and said longitudinal beam has a bolt guide within which said locking bolt is guided.

13. The apparatus as claimed in claim 1, further comprising means mounted on each of the forwardmost cross-pieces for changing the horizontal distance between the pair of longitudinal rails attached to the respective cross-piece.

* * * * *